US006503049B2

(12) United States Patent
Marx et al.

(10) Patent No.: US 6,503,049 B2
(45) **Date of Patent: *Jan. 7, 2003**

(54) FEED PUMP

(75) Inventors: Peter Marx, Wasbüttel (DE); Bernd Jäger, Fritzlar (DE)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/839,895

(22) Filed: Apr. 20, 2001

(65) Prior Publication Data

US 2002/0012584 A1 Jan. 31, 2002

(30) Foreign Application Priority Data

Apr. 20, 2000 (DE) ..... 100 19 909

(51) Int. Cl.[7] ..... F04D 5/00
(52) U.S. Cl. ..... 415/55.1
(58) Field of Search ..... 415/55.1–55.7; 403/383

(56) References Cited

U.S. PATENT DOCUMENTS

| | | | | |
|---|---|---|---|---|
| 2,080,272 A | * | 5/1937 | Hollman | 415/141 |
| 2,604,852 A | | 7/1952 | Baker | |
| 4,958,984 A | | 9/1990 | Aoi et al. | 415/55 |

FOREIGN PATENT DOCUMENTS

| | | | |
|---|---|---|---|
| DE | 2 023 834 | 11/1971 | F04D/29/20 |
| DE | 41 23 089 | 1/1993 | F04D/29/16 |
| DE | 44 37 935 | 6/1995 | F04D/5/00 |
| GB | 2 036 179 | 11/1979 | F04D/5/00 |
| JP | 57-151095 | 9/1982 | F04D/5/00 |

* cited by examiner

*Primary Examiner*—Edward K. Look
*Assistant Examiner*—Dwayne J. White
(74) *Attorney, Agent, or Firm*—Cohen, Pontani, Lieberman & Pavane

(57) ABSTRACT

In a feed pump designed as a side-channel pump, an impeller is held so as to be slightly pivotable with respect to a shaft about an axis running transversely to the shaft. The impeller is thereby adaptable to tolerances of a casing. Rubbing of the impeller on the casing is also prevented as a result. The feed pump consequently generates a particularly low level of noise.

9 Claims, 3 Drawing Sheets

FEED PUMP

BACKGROUND OF THE INVENTION

1. Field of the Invention

The invention relates to a feed pump for feeding fuel out of a fuel tank of a motor vehicle or for feeding washing fluid of a windshield washing system including a casing, an impeller arranged in the casing and connected on a driven shaft such that the impeller is fixed with respect to rotation relative to the driven shaft and a portion of the impeller is arranged with a slight clearance relative to the casing.

2. Description of the Related Art

Feed pumps for feeding fuel out of a fuel tank or for feeding washing fluid for a windshield washing system are typically designed as peripheral pumps or side-channel pumps and are known from practice. Each of these known pumps includes a casing which usually has two casing parts with a recess for the impeller. A particularly small sealing gap is arranged between the impeller and the casing parts in radially outer regions of the impeller which are adjacent to guide blades. An axial sliding bearing is usually also arranged in the sealing gap.

A problem with the known feed pump is that positional tolerances and the angle of inclination of the shaft with respect to the casing may lead to the impeller rubbing on the casing. This rubbing generates loud noises and, moreover, reduces the efficiency of the feed pump.

SUMMARY OF THE INVENTION

The object of the present invention is to provide a feed pump such that it generates a particularly low level of noise and has as high an efficiency as possible.

The object of the present invention is met by a feed pump including an impeller arranged on a shaft and having means for the movability of a radially outer region of the impeller in a pivoting direction relative to the shaft about an axis arranged transversely to the shaft and/or in an axial direction relative to a radially inner region of the impeller.

This configuration allows the radially outer region of the impeller to be tilted or slightly displaced by an intended amount in the casing. The position may be adjusted in the casing, for example, by the forces of the axial bearing of the impeller. Rubbing of the impeller on the casing is reliably avoided as a result. Furthermore, the formation of noise is kept particularly low due to the present invention. The feed pump according to the present invention has particularly high efficiency due to the constant sealing gap in the region adjacent to the guide blades.

To generate the pivotability of the impeller with respect to the shaft, a particularly large play may be arranged between the impeller and the shaft. However, the large play produces rattling noises when the shaft is driven and in the case of fluctuations in flow in the feed pump. According to an embodiment of the present invention, rattling noises may be kept particularly low when the impeller has, in its region adjacent to the shaft, a depression which surrounds the shaft. This configuration allows the connection of the impeller to the shaft to be restricted to intended dimensions for an intended height of the impeller. In the case of the very small play of the impeller with respect to the shaft, these dimensions are critical for the intended pivotability of the impeller. Another advantage of this configuration is that the impeller does not rub on the casing in the region of the depression.

The depression may be arranged on one end face of the impeller. However, the generation of noise in the feed pump according to the present invention is further reduced when a depression is arranged in each of the two end faces of the impeller.

According to another embodiment of the invention, play between the shaft and the impeller is kept particularly low, along with an intended pivotability of the impeller, when the impeller is designed to be elastic at least in its radially inner region. In the most favorable case, the impeller may be pressed on the shaft. The elastic design of the radially inner region allows simple pivotability and axial movability of the radially outer edge of the impeller.

The elastic region of the impeller could be generated, for example, by the impeller having in this region an insert consisting of an elastic material. However, according to another advantageous development of the invention, the elastic region of the impeller is particularly cost-effective when the impeller has a groove arranged concentrically to the shaft.

Feed pumps often have substantially higher efficiency in one direction of rotation of the impeller than in the opposite direction of rotation. To ensure an intended high efficiency of the feed pump in a particularly simple way, the shaft and/or the impeller may have means for arranging them in the correct position. By virtue of this configuration, the impeller must be arranged in place on the shaft. Accordingly, the direction of rotation of the impeller is reliably fixed.

According to another embodiment of the present invention, the means for arranging the impeller in the correct position are configured in a particularly simple way in terms of design when the impeller has a projection, arranged near one of its end faces for engaging into a step-like recess of the shaft. The recess is configured according to the projection. Furthermore, the shaft is held axially nondisplaceably with respect to the casing. The casing may thereby be mounted only when the impeller is fastened in the correct position on the shaft.

According to yet another embodiment of the invention, the means for arranging the impeller in the correct position include two flattenings which are nonparallel and/or have different dimensions for connection to a correspondingly configured recess of the impeller. This configuration requires a particularly low outlay in terms of construction and the connection is positive in the direction of rotation.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1:
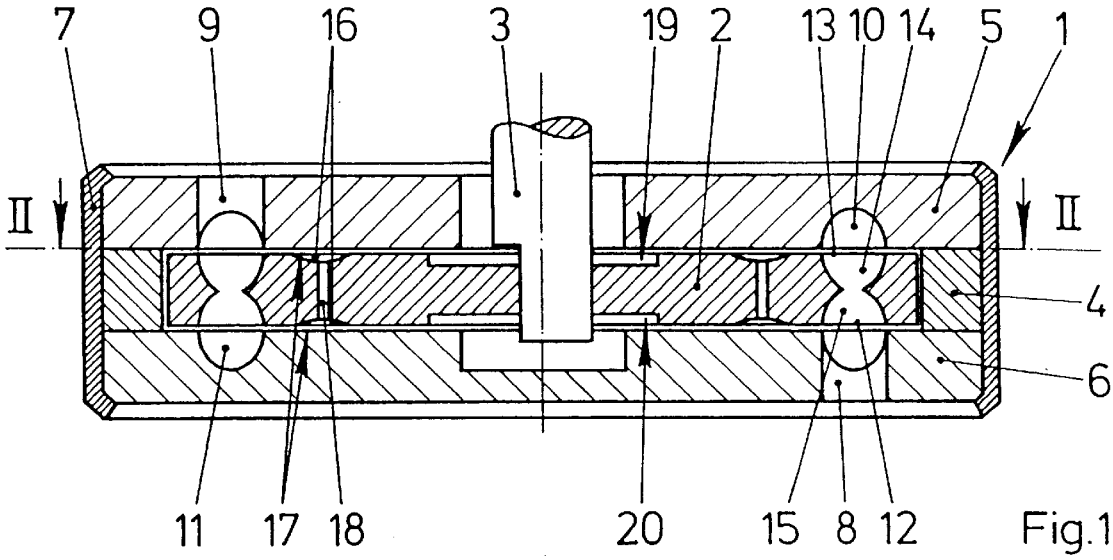
FIG. 1 is a longitudinal sectional view of a feed pump according to an embodiment of the present invention.

FIG. 1 is a sectional view of a feed pump according to the present invention designed as a side-channel pump with an impeller 2 rotatably arranged in a casing 1. The impeller 2 is arranged so that it is fixed with respect to rotation relative to a driven shaft 3 and slightly axially displaceable on the driven shaft 3. The shaft 3 may, for example, be designed as a motor shaft of an electric motor (the electric motor is not illustrated in FIG. 1). The casing 1 includes two casing parts 5, 6 held with clearance by a ring 4 and a sheet-metal strip 7 rolled at the edges of the casing parts 5, 6 and intended for prestressing the casing parts 5, 6 against the ring 4. An inlet channel 8 is arranged in one of the casing parts 6 and an outlet channel 9 is arranged in the other casing part 5. The inlet channel 8 and the outlet channel 9 are respectively connected to part-annular channels 10, 11. The impeller 2 has blade chambers 14, 15 arranged in the region of the part-annular channels 10, 11. The blade chambers 14, 15 are delimited by guide blades 12, 13. The casing 1 is located with particularly slight clearance opposite the impeller 2 to form sealing gaps in the region of the blade chambers 14, 15. Pockets 16 of axial sliding bearings 17 are arranged in the end faces of the impeller 2. The pockets 16 are in each case located opposite one another and connected to one another by ducts 18.

Rotation of the impeller 2 in the casing 1 produces a flow of a medium such as, for example, fuel or windshield washing fluid from the inlet channel 8 to the outlet channel 9. The feed pump may, of course, also be designed as a peripheral pump, in which the guide blades 12, 13 are arranged on the outer circumference of the impeller 2.

Depressions 19, 20 are arranged in a radially inner region of each of the two end faces of the impeller 2. These depressions 19, 20 limit the dimensions of the impeller 2 which contact the shaft 3. The impeller 2 is connected to the shaft 3 with play to allow slight axial displacement of the impeller 2 on the driven shaft 3. The depressions 19, 20 and the play between the impeller 2 and the shaft 3 allow the impeller 2 to tilt slightly about an axis running perpendicular to the longitudinal axis of the shaft 3. The radially outer region of the impeller 2 in which the blade chambers 14, 15 are arranged may thereby adapt to the dimensions of the casing 1. This adaptation is improved, moreover, by the impeller 2 being designed to be slightly elastic in its radially inner region due to the depressions 19, 20. The position of the radially outer region of the impeller 2 is set by the forces of the axial sliding bearing 17. Accordingly, a rubbing of the impeller 2 on the casing parts 5, 6 is thus prevented.

Figure 2:
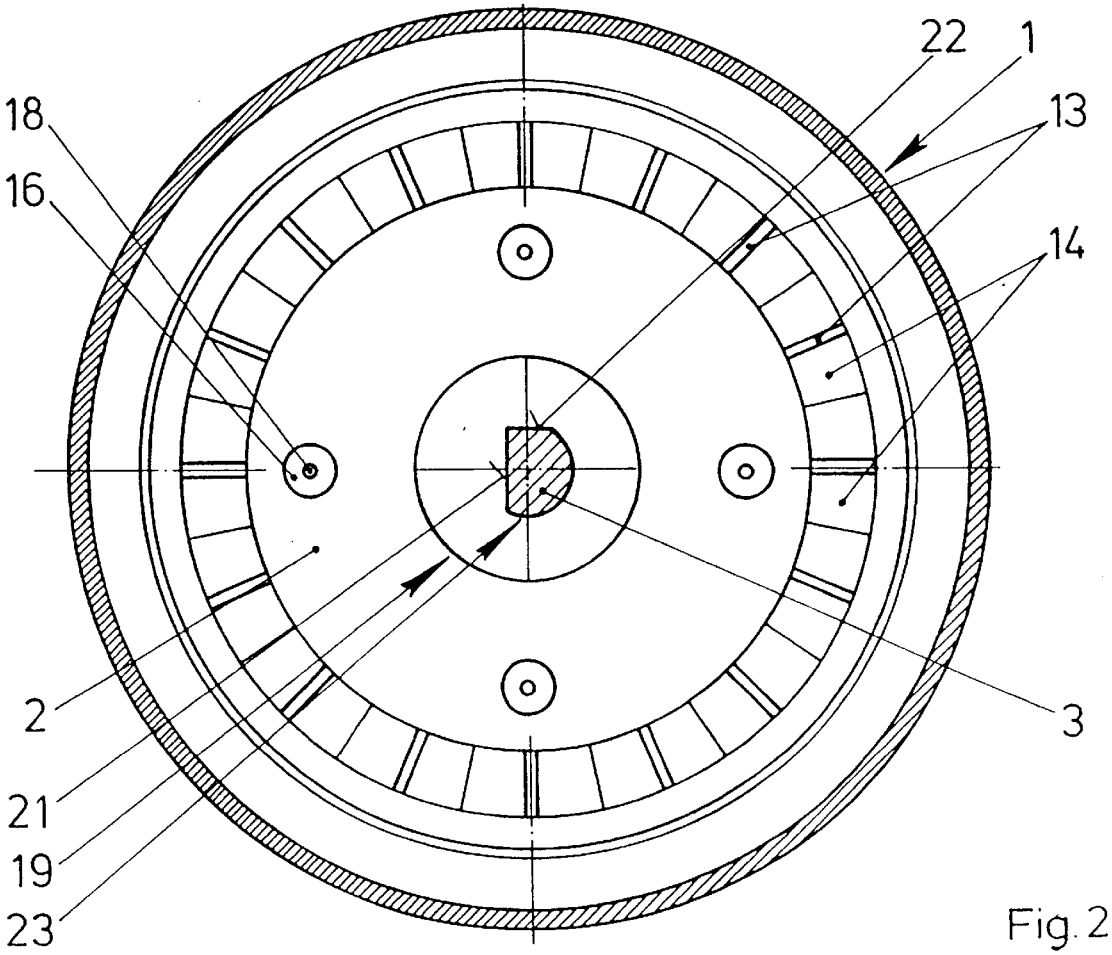
FIG. 2 is a sectional view through the feed pump according to FIG. 1 along the line II—II.

FIG. 2 is a sectional illustration through the feed pump of FIG. 1 along the line II—II and shows that the shaft 3 has on its outer surface two flattenings 21, 22 for making a rotationally fixed connection to the impeller 2. The impeller 2 has a recess 23 configured according to the shaft 3. The flattenings 21, 22 are arranged at an angle of $\neq 180°$ to one another and are therefore nonparallel. The impeller 2 may thereby be mounted on the shaft 3 only in an intended direction of rotation and therefore in the correct position. To further ensure the correct mounting position, the flattenings 21, 22 may additionally or alternatively have different dimensions.

Figure 3:
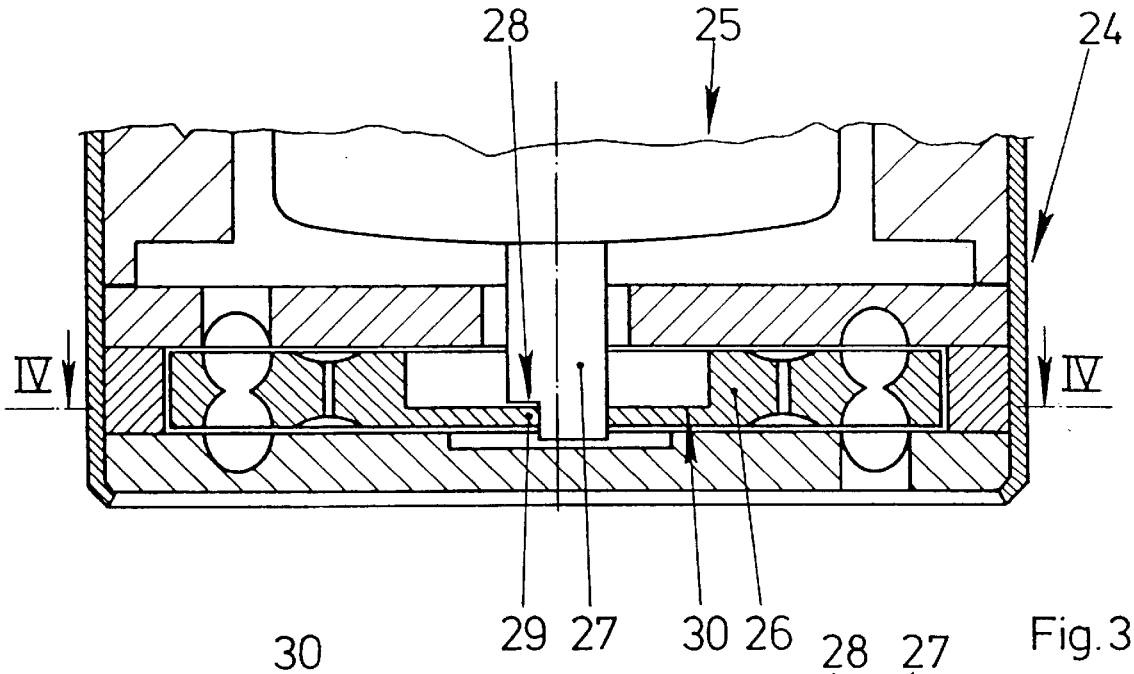
FIG. 3 is a longitudinal sectional view of a feed pump according to a further embodiment of the present invention.

FIG. 3 shows a further embodiment of the feed pump according to the present invention in which a casing 24 is connected axially nondisplaceably to an electric motor 25 intended for driving said feed pump. A shaft 27 of the electric motor 25 is connected to an impeller 26 positively in the direction of rotation. The shaft 27 has a step-like recess 28 for receiving a projection 29 of the impeller 26. The casing 24 of the feed pump is connected axially nondisplaceably to an electric motor 25. The impeller 26 may therefore only be mounted in the casing 24 in the depicted position in an intended direction of rotation. The impeller 26 has a depression 30 in the region of the shaft 27. The dimensions of the depression 30 in the impeller 26 limit the dimensions of the connection of the impeller 26 to the shaft 27 to an intended amount. The radially outer region of the impeller 26 may thereby tilt slightly with respect to the shaft 27 and consequently adapt to tolerances of the casing 24. The radial dimensions of the depression 30 are sized to ensure an intended elasticity of the radially inner region of the impeller 26.

Figure 4:
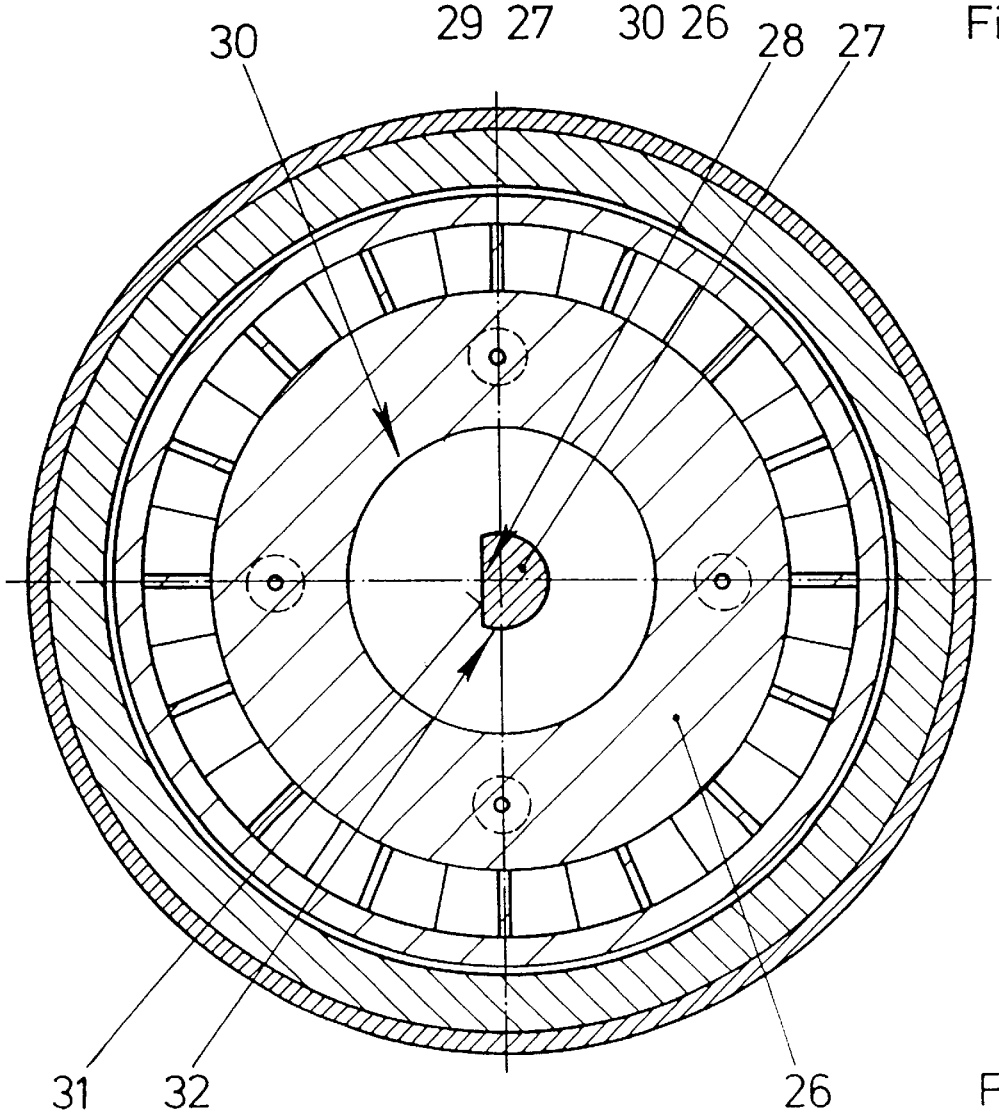
FIG. 4 is a sectional view through the feed pump according to FIG. 3 along the line IV—IV.

FIG. 4 is a sectional illustration through the feed pump of FIG. 3 along the line IV—IV which shows that the step-like recess 28 of the shaft 27 has a flattening 31 for rotationally fixed connection to a correspondingly configured recess 32 of the impeller 26.

Figure 5:
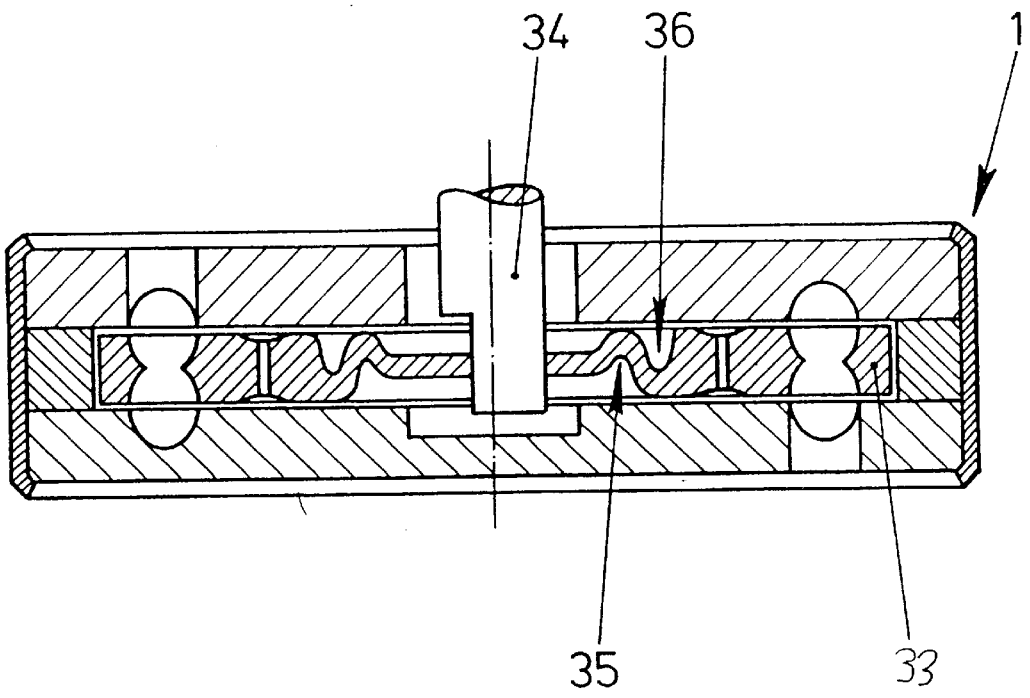
FIG. 5 is a longitudinal sectional view of a feed pump according to yet another embodiment of the present invention.

FIG. 5 shows a further embodiment of the feed pump of the present invention. The feed pump of FIG. 5 differs from that shown in FIG. 1 primarily in that an impeller 33 has two grooves 35, 36 arranged concentrically to a shaft 34. These grooves 35, 36 generate elasticity in the radially inner region of the impeller 33 and therefore allow slight axial movability and pivotability of its radially outer region about an axis arranged perpendicularly to the drawing plane. The impeller 33 may therefore be fastened, free of play, onto the shaft 34.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A feed pump for feeding one of fuel and windshield washing fluid, comprising:

a casing;

a driven shaft;

an impeller arranged on said driven shaft so that said impeller is fixed with respect to rotation relative to said driven shaft, said impeller being arranged in said casing such that a slight clearance is arranged between a portion of said impeller and said casing for forming sealing gaps between said portion of said impeller and said casing, said impeller having a radially outer region and a radially inner region and said radially outer region being movable in at least one of a pivoting direction relative to said driven shaft about an axis transverse to said driven shaft and an axial direction relative to said radially inner region of said impeller, said impeller comprising a depression in a region of said impeller proximate said driven shaft, said depression surrounding said shaft.

2. The feed pump of claim 1, wherein said impeller comprises two opposing end faces and a depression arranged in each of said two end faces of said impeller in a region of said ends faces adjacent to said driven shaft, said depression surrounding said driven shaft.

3. The feed pump of claim 1, wherein said radially inner region of said impeller is elastic.

4. The feed pump of claim 3, wherein said impeller comprises a groove arranged concentrically to said driven shaft in said radially inner region of said impeller.

5. The feed pump of claim 1, further comprising means for positioning said impeller in a correct position relative to said driven shaft.

6. The feed pump of claim 5, wherein said means for positioning comprises a projection arranged proximate an end face of said impeller and said driven shaft comprises a step-like recess, said end face engaging said step-like recess such that said driven shaft is held axially nondisplaceably relative to said casing.

7. The feed pump of claim 5, wherein said means for positioning comprises two flattenings arranged on an outer surface of said driven shaft, and a recess arranged on said impeller, said two flattenings being nonparallel and arranged for forming a connection to said recess of said impeller such that said connection is positive in the direction of rotation.

8. The feed pump of claim 5, wherein said means for positioning comprises two flattenings arranged on an outer surface of said driven shaft, and a recess arranged on said impeller, said two flattenings having different dimensions and arranged for forming a connection to said recess of said impeller such that said connection is positive in the direction of rotation.

9. The feed pump of claim 8, wherein said two flattenings are nonparallel.

* * * * *